United States Patent [19]

Cortese

[11] Patent Number: 5,039,100

[45] Date of Patent: Aug. 13, 1991

[54] GOAL POST MAGNET ARRANGEMENT

[76] Inventor: Robert A. Cortese, 500 Bensel Dr., Apt. D-32, Landing, N.J. 07850

[21] Appl. No.: 574,888

[22] Filed: Aug. 30, 1990

[51] Int. Cl.[5] ..... A63B 63/00

[52] U.S. Cl. ..... 273/127 B; 273/29 BB

[58] Field of Search ..... 273/29 BB, 126 R, 410, 273/26 A

[56] References Cited

U.S. PATENT DOCUMENTS

| | | | |
|---|---|---|---|
| 4,083,516 | 4/1978 | Daffer, Jr. | 273/127 B |
| 4,407,505 | 10/1983 | Kendziorski | 273/29 BB |
| 4,420,158 | 12/1983 | Klock | 273/127 B |
| 4,462,384 | 5/1987 | Solla | 273/127 B |
| 4,619,456 | 10/1988 | Meggs | 273/127 B |
| 4,898,392 | 2/1990 | Goletz | 273/127 B |

*Primary Examiner*—Theatrice Brown

*Attorney, Agent, or Firm*—Leon Gilden

[57] ABSTRACT

An apparatus wherein a plurality of spaced goal posts mounting a net coextensively therebetween each include a lower terminal end securable to a respective magnetic mounting arrangement. A cylindrical base includes an annular groove to receive the lower terminal end of each goal post with an upwardly extending cylindrical boss directed interiorly of each goal post including a conical upper surface to enhance ease of displacement of an associated goal post relative to the boss upon impact with the goal post. Modifications of the invention may include a deformable support including an annular magnet positioned within the groove to secure a lower terminal end of each goal post therewithin. A further modification of the invention includes the use of diametrically opposed magnetic plugs mounted within the goal posts cooperative with the cylindrical boss formed of an attractive ferro-magnetic material.

5 Claims, 4 Drawing Sheets

PRIOR ART

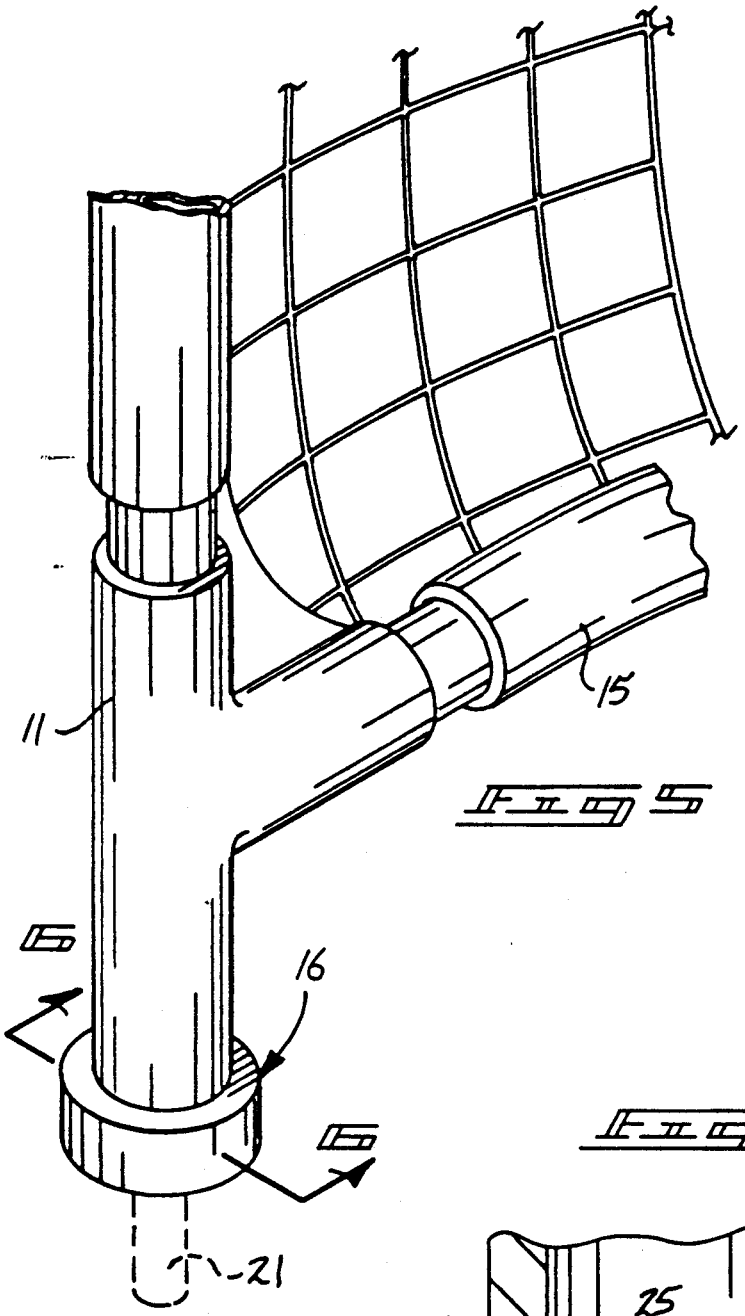
FIG 5
FIG 6
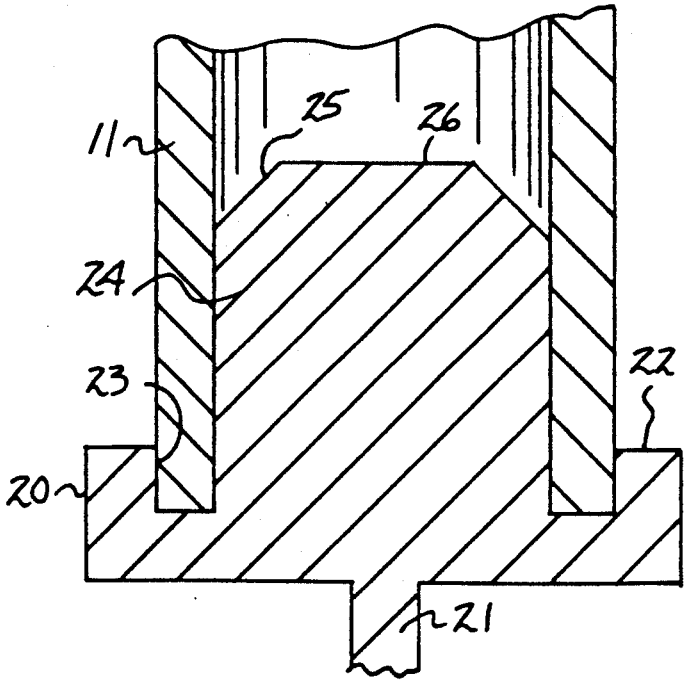

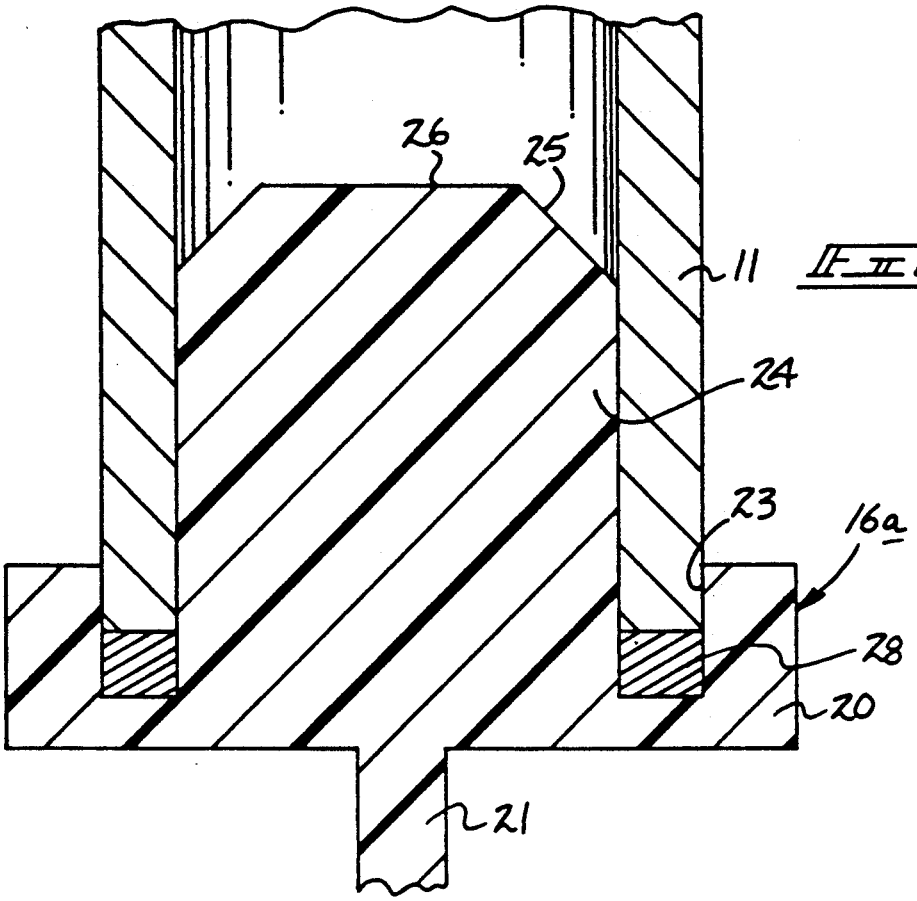
Fig 7
Fig 8
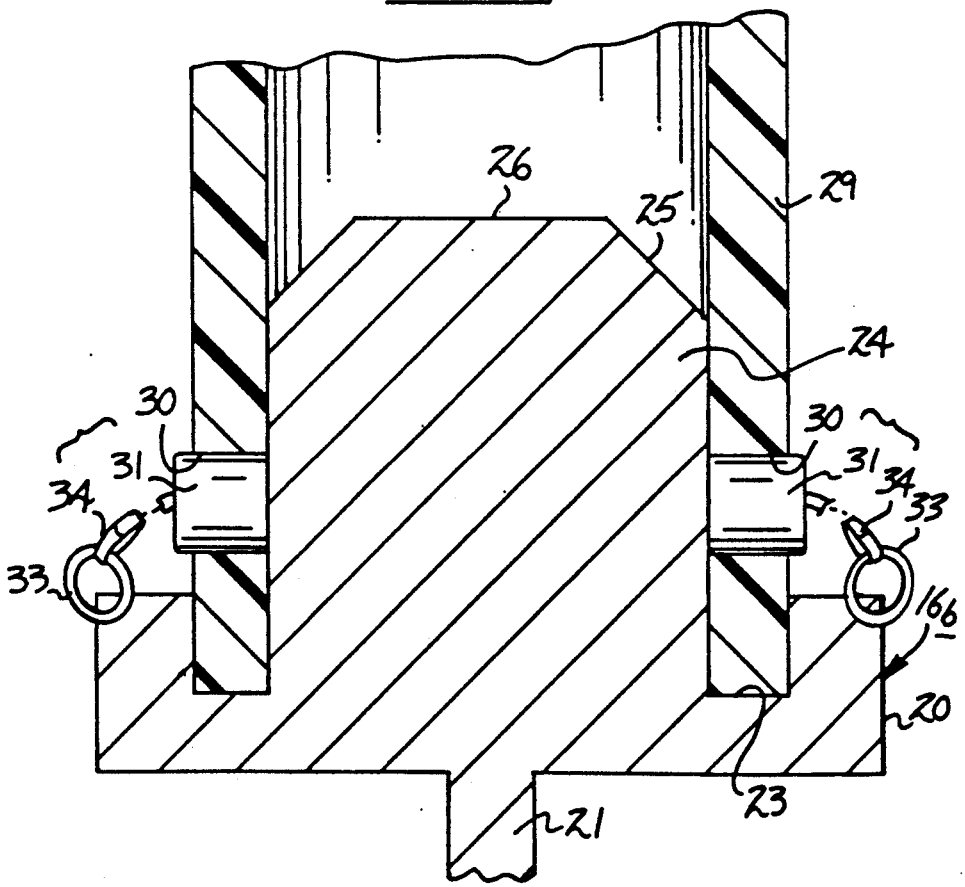

GOAL POST MAGNET ARRANGEMENT

BACKGROUND OF THE INVENTION

1. Field of the Invention

The field of the invention relates to goal post magnet arrangements, and more particularly pertains to a new and improved goal post magnet arrangement wherein the same provides a break away mount for an associated goal post utilized in a sporting event.

2. Description of the Prior Art

In sporting events such as ice hockey, occasional impact with goal posts of the game occur. It is necessary that the goal posts be non-fixedly secured to permit their ability to break-away during such impact. A prior art device addressing the problem is set forth in U.S. Pat. No. 4,619,456 to MAGGS wherein a magnetic core positioned within a goal post is attracted to an underlying magnetically attractive plate to permit the break-away feature.

U.S. Pat. No. 4,420,158 to KLOCK et al sets forth a portable field goal assembly that permits selectively positioning of a goal post in a variety of locations.

U.S. Pat. No. 4,805,903 to MCARDLE sets forth a basketball net fixture that may be easily installed or moved relative to missing basketball hoop utilizing magnetic strip within the fixture to secure the fixture to an associated basketball hoop.

U.S Pat. No. 4,979,120 to DIETRICH sets forth a hockey goal construction utilizing deformable joints to permit the goal to be displaced upon impact.

As such, it may be appreciated that there continues to be a need for a new and improved goal post magnetic arrangement as set forth by the instant invention which addresses both the problems of ease of use as well as effectiveness in construction in providing a break away mount for an associated goal post utilized in a sporting event and as such, the present invention substantially fulfills this need.

SUMMARY OF THE INVENTION

In view of the foregoing disadvantages inherent in the known types of goal post structure present in the prior art, the present invention provides a new and improved goal post magnetic arrangement wherein the same selectively secures a goal post member to an associated mounting plug utilizing magnetic attraction. As such, the general purpose of the present invention, which will be described subsequently in greater detail, is to provide a new and improved goal post magnet arrangement which has all the advantages of the prior art goal post organizations and none of the disadvantages.

To attain this, the goal post magnet arrangement of the instant invention includes an apparatus wherein a plurality of spaced goal posts mounting a net coextensively therebetween each include a lower terminal end securable to a respective magnetic mounting arrangement. A cylindrical base includes an annular groove to receive the lower terminal end of each goal post with an upwardly extending cylindrical boss directed interiorly of each goal post including a conical upper surface to enhance ease of displacement of an associated goal post relative to the boss upon impact with the goal post. Modifications of the invention may include a deformable support including an annular magnet positioned within the groove to secure a lower terminal end of each goal post therewithin. A further modification of the invention includes the use of diametrically opposed magnetic plugs mounted within the goal posts cooperative with the cylindrical boss formed of an attractive ferro-magnetic material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved goal post magnet arrangement which has all the advantages of the prior art goal post magnet arrangement and none of the disadvantages.

It is another object of the present invention to provide a new and improved goal post magnet arrangement which may be easily and efficiently manufactured and marketed.

It is a further object of the present invention to provide a new and improved goal post magnet arrangement which is of a durable and reliable construction.

An even further object of the present invention is to provide a new and improved goal post magnet arrangement which is susceptible of a low cost of manufacture with regard to both materials and labor, and which accordingly is then susceptible of low prices of sale to the consuming public, thereby making such goal post magnet arrangements economically available to the buying public.

Still yet another object of the present invention is to provide a new and improved goal post magnet arrangement which provides in the apparatuses and methods of the prior art some of the advantages thereof, while simultaneously overcoming some of the disadvantages normally associated therewith.

Still another object of the present invention is to provide a new and improved goal post magnet arrangement which may be compactly stored when not being utilized.

Yet another object of the present invention is to provide a new and improved goal post magnet arrangement wherein the same provides for a properly anchored goal structure which may be displaced upon impact.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the goal support post mounted to the mount of the instant invention.

FIG. 6 is an orthographic view taken along the lines 6—6 of FIG. 5 in the direction indicated by the arrows.

FIG. 7 is an orthographic cross-sectional view of a modified support of the instant invention.

FIG. 8 is an orthographic cross-sectional view of a further modified mount utilized by the instant invention.

DESCRIPTION OF THE PREFERRED EMBODIMENT

Figure 1:
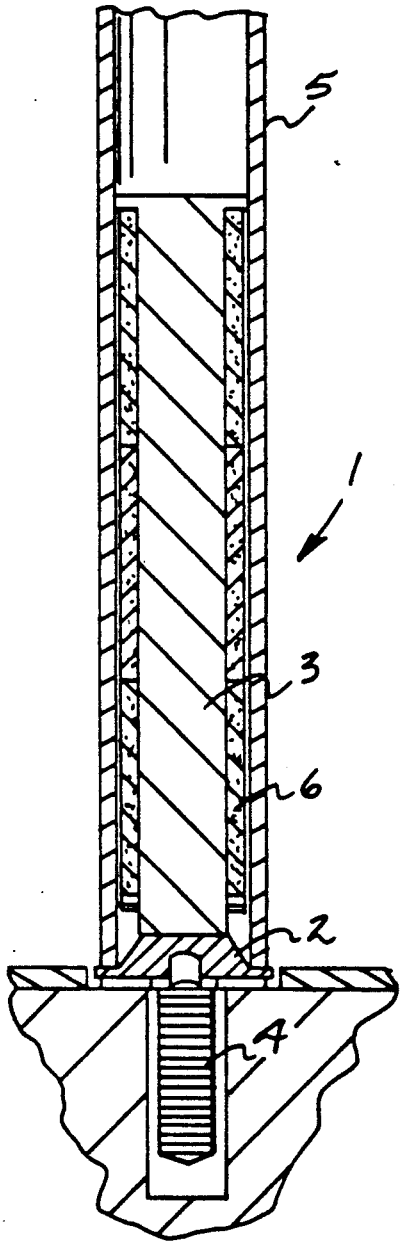
FIG. 1 is an orthographic cross-sectional view of a prior art magnetic goal post support structure.
Figure 2:
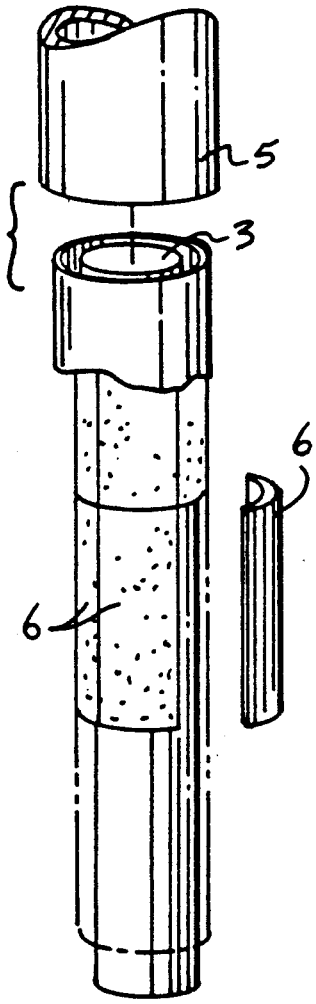
PRIOR ART Fig 2
FIG. 2 is an isometric illustration of the goal post structure as set forth in FIG. 1.
Figure 3:
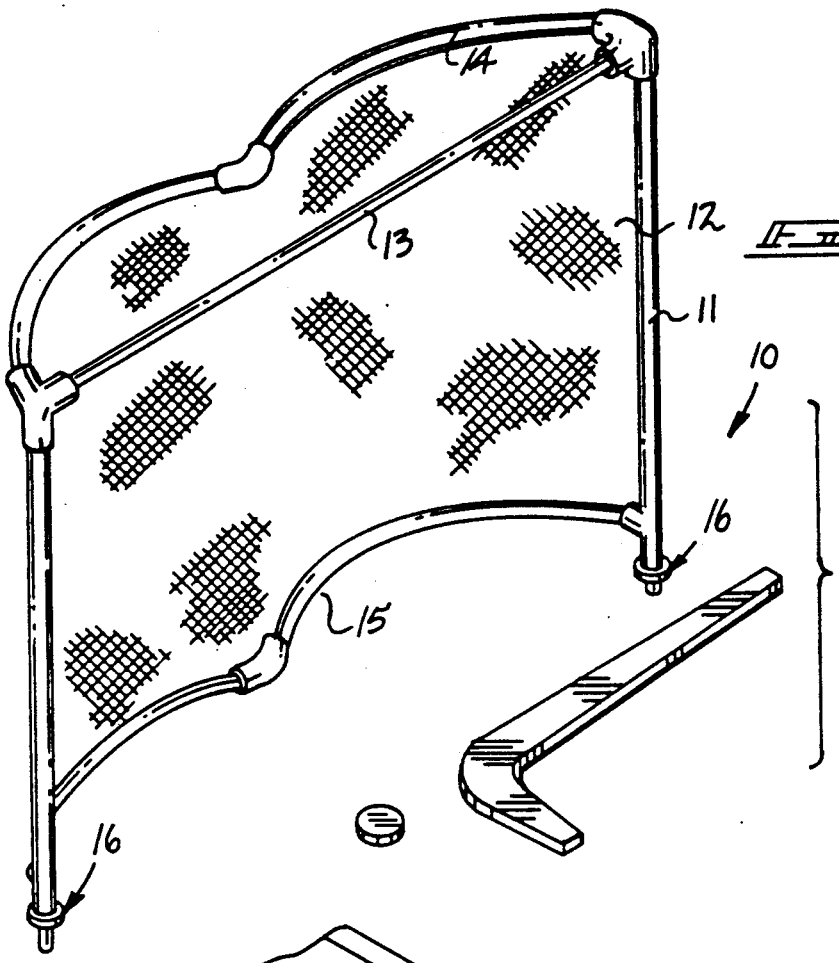
FIG. 3 is a isometric illustration of a hockey goal post structure magnetically secured to the supports of the instant invention.

With reference now to the drawings, and in particular to FIGS. 1 to 8 thereof, a new and improved goal post magnet arrangement embodying the principles and concepts of the present invention and generally designated by the reference numeral 10 will be described.

FIG. 1 illustrates a prior art goal post magnet arrangement wherein a ferro-magnetic core includes a plurality of spaced magnetic segments 6 positioned therewithin secured within an associated goal post 5. A lower terminal end of the goal post is mounted upon an anchor plate 2 in turn mounted to a support post 4.

Figure 4:
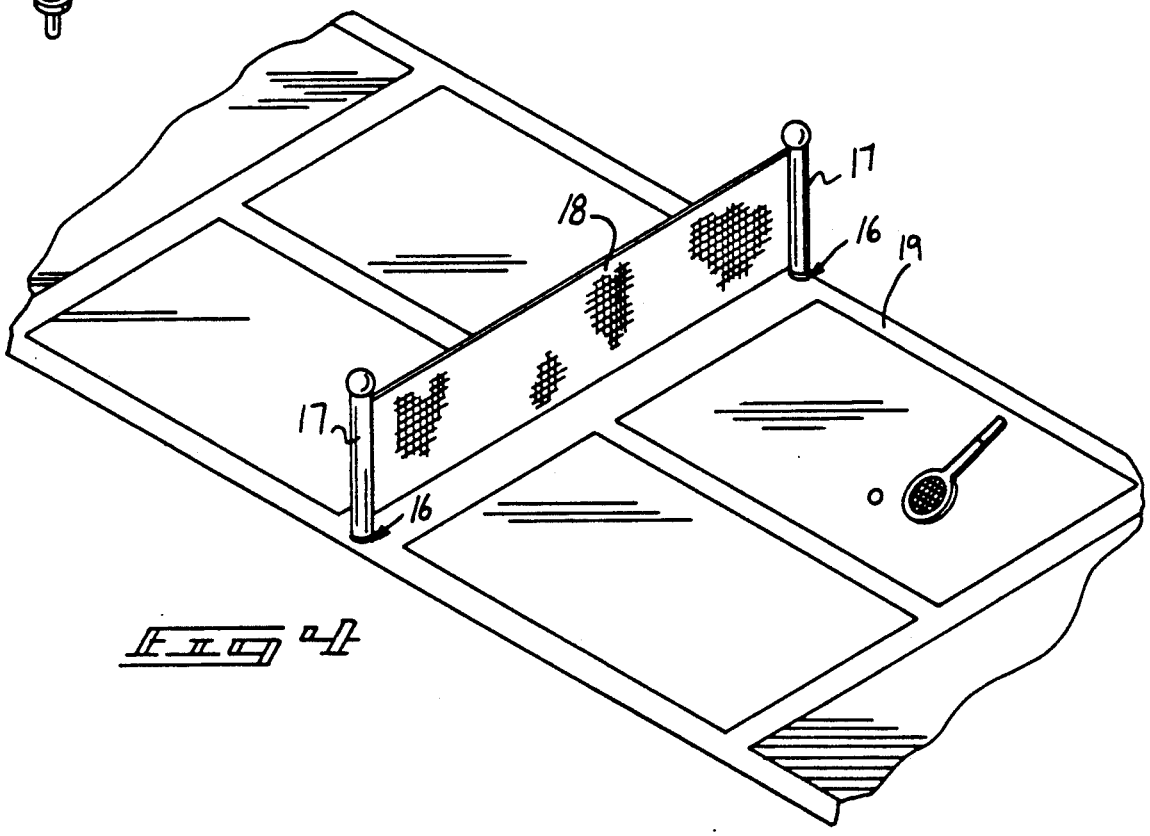
FIG. 4 is an isometric illustration of a tennis net support structure mounted to the supports of the instant invention.

More specifically, the goal post magnet arrangement 10 of the instant invention essentially comprises magnetic association with a plurality of spaced tubular goal support posts 11 including a net 12 coextensively mounted therebetween. The hockey goal arrangement as set forth in FIG. 1 includes an upper frame member 13 with an overlying top frame assembly 14 and an underlying spaced parallel lower frame member 15. It is noted that the spaced tubular goal posts 11 are defined by a predetermined internal diameter defined by a first diameter. Each lower terminal annular end of the goal posts 11 is mounted and magnetically adhered to a support 16. Similarly, FIG. 4 illustrates the use of spaced tennis support posts 17 including elongate tennis net member 18 coextensively directed therebetween utilized in conventional playing court 19.

The support 16 secure to each lower annular end of each post 11 for example includes a cylindrical base 20 defined by a second diameter greater than the first diameter with a support shank 21 integrally mounted to a lower bottom surface of the base 20 orthogonally directed thereto wherein the support shank 21 is arranged for securement into a supporting ground surface and the like. The top surface 22 of each cylindrical base 20 includes an annular groove defined by a diameter substantially equal to the first diameter and of a width substantially equal to a wall thickness defined by the goal support post 11.

A cylindrical central boss 24 projects upwardly beyond the top surface 22 and is coaxially aligned with the base 20 and the support shank 21 to include a conically tapered upper end wall surface 25 in surrounding relationship relative to a top boss wall surface 26 to permit ease of disassembly of the boss 24 relative to an associated goal post 11 upon impact of the goal post during play. The support 16 is formed of a ferro-magnetic material to effect magnetic attraction to a metallic support post 11 as illustrated.

FIG. 7 illustrates the use of a modified support 16 formed of a deformable polymeric material to enhance ease of displacement of the metallic goal post 11. The modified support **16*a* is formed of an identical configuration to that as illustrated in FIG. 6 but includes annular ferro-magnetic loop 28 fixedly mounted within the groove 23 to magnetically secure and adhere the goal post 11 thereto. The support 11 may be formed of any suitable polymeric material accommodating a degree of flexure to enhance displacement of the goal post 11 from the support 16*a*** during impact in play of the game such as ice hockey.

FIG. 8 illustrates a further modified support **16*b* formed of a metallic construction for use with polymeric type goal posts 29 of identical geometric construction to that as set forth in FIG. 7 for example. Additionally, the polymeric goal posts 29 each includes a plurality of diametrically opposed cylindrical through extending bores 30. Fixedly mounted within each of the bores is a ferro-magnetic plug 31. The ferro-magnetic plug includes an elongate tether line 34 mounted to a supporting ring 33 that is in turn fixedly mounted to the base 20 of the modified metallic support 16*b***. In this manner, the organization accommodates the use of polymeric type goal post in leu of metallic goal posts.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A goal post apparatus comprising in combination, a plurality of tubular goal posts, said goal posts including a net extending coextensively therebetween, and each goal post including a lower annular terminal end;

support means having a magnetic attraction means positioned between said support means and said lower terminal end of each said posts, said support means includes a cylindrical base, said cylindrical base having an integrally and orthogonally mounted support shank coaxially aligned and extending from a bottom surface of said cylindrical base, and said cylindrical base further includes an annular groove, said groove being defined by inner and outer predetermined diameters, each said lower terminal end of said goal post being defined by said predetermined diameters to secure said lower terminal end of a respective goal post within said annular groove and releasably held therein to said magnetic attraction means.

2. Apparatus as set forth in claim 1 wherein said annular groove is directed into the support base from a top surface of the support base, and a cylindrical central boss defined by a boss diameter substantially equal to the said inner diameter and projecting upwardly coaxially beyond the top surface of the support base and including a conically tapered upper end side wall surface spaced above the top surface and extending into said tubular goal posts.

3. Apparatus as set forth in claim 2 wherein the goal post is formed of a metallic magnetically attractable material, and the support means is formed of a ferro-magnetic material.

4. Apparatus as set forth in claim 2 wherein the support means is formed of a deformable polymeric material, and the annular groove includes a ferro-magnetic loop mounted within the groove and fixedly mounted thereto, and each goal post is formed of a metallic magnetically attractive material.

5. Apparatus as set forth in claim 2 wherein the goal post is formed of a polymeric material, and includes a plurality of diametrically opposed bores directed through each goal post adjacent the lower terminal end, and the support means is formed of a metallic magnetically attractable material, and each bore includes a ferro-magnetic plug secured within each bore to effect magnetic attraction to the support means, and each magnetic plug includes an elongate tether mounted to each plug, and each tether is mounted to a support ring spaced from each plug, and each support ring is fixedly mounted to the cylindrical base.

* * * * *